US006817183B2

(12) United States Patent
Modi et al.

(10) Patent No.: US 6,817,183 B2
(45) Date of Patent: Nov. 16, 2004

(54) LIQUID FUEL INJECTOR FOR BURNERS OF GAS TURBINES

(75) Inventors: Roberto Modi, San Piero a Sieve (IT); Luciano Bonciani, Florence (IT); Gianni Ceccherini, Sesto Fiorentino (IT)

(73) Assignee: Nuovo Pignone Holding S.p.A., Florence (IT)

( * ) Notice: Subject to any disclaimer, the term of this patent is extended or adjusted under 35 U.S.C. 154(b) by 41 days.

(21) Appl. No.: 10/320,664

(22) Filed: Dec. 17, 2002

(65) Prior Publication Data

US 2003/0115880 A1 Jun. 26, 2003

(30) Foreign Application Priority Data

Dec. 21, 2001 (IT) ..... MI2001A2784

(51) Int. Cl.[7] ..... F23R 3/14; B05B 7/10

(52) U.S. Cl. ..... 60/748; 239/403; 239/405; 239/406

(58) Field of Search ..... 60/740, 748; 239/403, 239/405, 406

(56) References Cited

U.S. PATENT DOCUMENTS

| | | | | | |
|---|---|---|---|---|---|
| 1,500,012 | A | * | 7/1924 | Staples | 239/405 |
| 1,997,066 | A | * | 4/1935 | Mettler | 239/406 |
| 2,286,581 | A | * | 6/1942 | Scott | 239/405 |
| 2,308,439 | A | * | 1/1943 | Carroll | 239/406 |
| 2,701,164 | A | * | 2/1955 | Purchas, Jr. et al. | 60/742 |
| 2,762,656 | A | * | 9/1956 | Fraser | 60/740 |
| 4,595,355 | A | * | 6/1986 | Garrelfs et al. | 431/265 |
| 5,224,333 | A | * | 7/1993 | Bretz et al. | 60/740 |
| 5,697,553 | A | * | 12/1997 | Stotts | 239/406 |
| 5,827,054 | A | * | 10/1998 | Sarv et al. | 239/406 |
| 6,272,840 | B1 | * | 8/2001 | Crocker et al. | 60/748 |
| 6,276,924 | B1 | * | 8/2001 | Joshi et al. | 431/9 |

* cited by examiner

*Primary Examiner*—Ted Kim
(74) *Attorney, Agent, or Firm*—Nixon & Vanderhye

(57) ABSTRACT

An improved liquid fuel injector (10) for burners of gas turbines, of the type comprising a tube (16) which supplies the liquid fuel to an injector head (12), an external tube (24) being provided around the tube (16) to form an annular cavity (26) where pressurized air is supplied, and a covering element (28) being provided around the head (12) to form a cavity (32); a turbulence element (18) comprising blading (22) is provided before the head (12).

3 Claims, 2 Drawing Sheets

10
26
24
16
25
18
32
20
22
28
34
30
12
14

LIQUID FUEL INJECTOR FOR BURNERS OF GAS TURBINES

The present invention relates to an improved liquid fuel injector for burners of gas turbines.

As is known, a gas turbine is a machine consisting of a compressor and a turbine with one or more stages, in which these components are interconnected by a rotating shaft and in which a combustion chamber is provided between the compressor and the turbine.

Air from the external environment is supplied to the compressor where it is pressurized.

The pressurized air passes through a series of premixing chambers, each terminating in a nozzle or converging portion, and an injector supplies fuel to each of these chambers, this fuel being mixed with the air to form a fuel-air mix for combustion.

The fuel required for the combustion, which is designed to cause an increase in temperature and enthalpy of the gas, is introduced into the combustion chamber by means of one or more burners, supplied from a pressurized network.

A parallel fuel supply system, for generating pilot flames in the proximity of the outlet of the burner, is also generally provided, generally where gas fuel is used, in order to improve the stability characteristics of the flame.

The gas at high temperature and high pressure then passes through suitable ducts to reach the various stages of the turbine, which converts the enthalpy of the gas into mechanical energy which is available to a user.

Known burner units have a complex structure, within which there is an injector, contained within a converging casing.

The injector, which is obviously connected to a liquid fuel supply line running from a remote reservoir, generally has a body with a cylindrical portion and a pointed terminal portion.

The known type of liquid fuel injector for burners in gas turbines has a channel for the passage of the fuel and has channels for the admission of pressurized air from the turbine compressor.

Both the fuel channel and the pressurized air channel terminate in suitable outlet holes, where the air leaving the injector is used to vaporize the fuel to improve the combustion characteristics.

It is well known that the primary considerations in the design of combustion chambers for gas turbines are the flame stability and the control of excess air, the aim being to establish ideal conditions for the combustion.

A second factor which influences the design of combustion chambers of gas turbines is the tendency to make the combustion take place as close as possible to the dome of the combustion chamber.

Other problems which are particularly significant in the technical field of burners include the necessity of achieving optimal atomization of the liquid fuel and suitable mixing according to the different characteristics of the fuels used.

Finally, it is desirable to achieve optimal conditions of turbulence of the fluids concerned in the premixing area, and to reduce the emission of combustion byproducts, particularly pollutants such as nitrogen oxides.

The object of the present invention is therefore to improve the aforementioned liquid fuel injector for burners of gas turbines in such a way that the emission of pollutants is minimized, but with consideration of other requirements for satisfactory combustion such as those mentioned immediately below.

Another object of the present invention must therefore be to provide a liquid fuel injector for burners of gas turbines which also provides high flame stability.

The objects of the present invention also include the provision of an improved liquid fuel injector for burners of gas turbines which reduces the pressure oscillations in the combustion chamber.

Yet another object of the present invention is to provide an improved liquid fuel injector for burners of gas turbines which produces high combustion efficiency.

An additional object of the present invention is to provide an improved liquid fuel injector for burners of gas turbines which makes it possible to increase the average life of components subject to high temperatures.

Another additional object of the present invention is to provide an improved liquid fuel injector for burners of gas turbines with low emission of pollutants which has an extremely simple and compact structure but which maintains optimal fluid dynamic characteristics.

Finally, another object of the invention is to provide an improved liquid fuel injector for burners of gas turbines which provides excellent reliability of operation of the machine, and which can be made at low cost because it consists of a small number of components: this also facilitates dismantling and maintenance.

These and other objects of the present invention are achieved by making an improved liquid fuel injector for burners of gas turbines as described in Claim 1.

Further characteristics are specified in the subsequent claims.

The characteristics and advantages of an improved liquid fuel injector for burners of gas turbines according to the present invention will be made clearer by the following description, provided by way of example, and without restrictive intent, with reference to the attached schematic drawings, in which.

Figure 1:
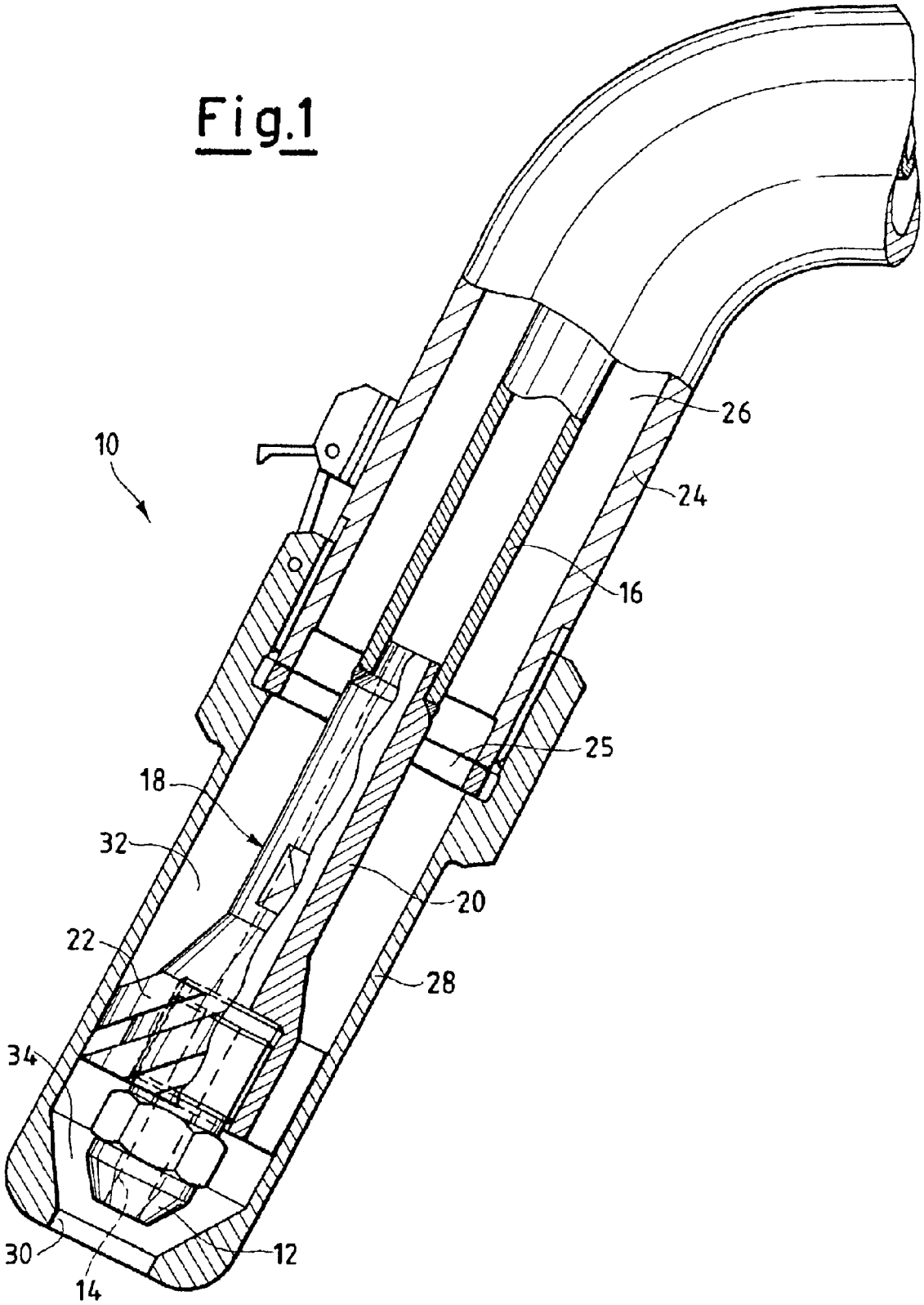
FIG. 1 is a lateral elevation view, partially in section, of a liquid fuel injector for burners of gas turbines according to the present invention.
Figure 2:
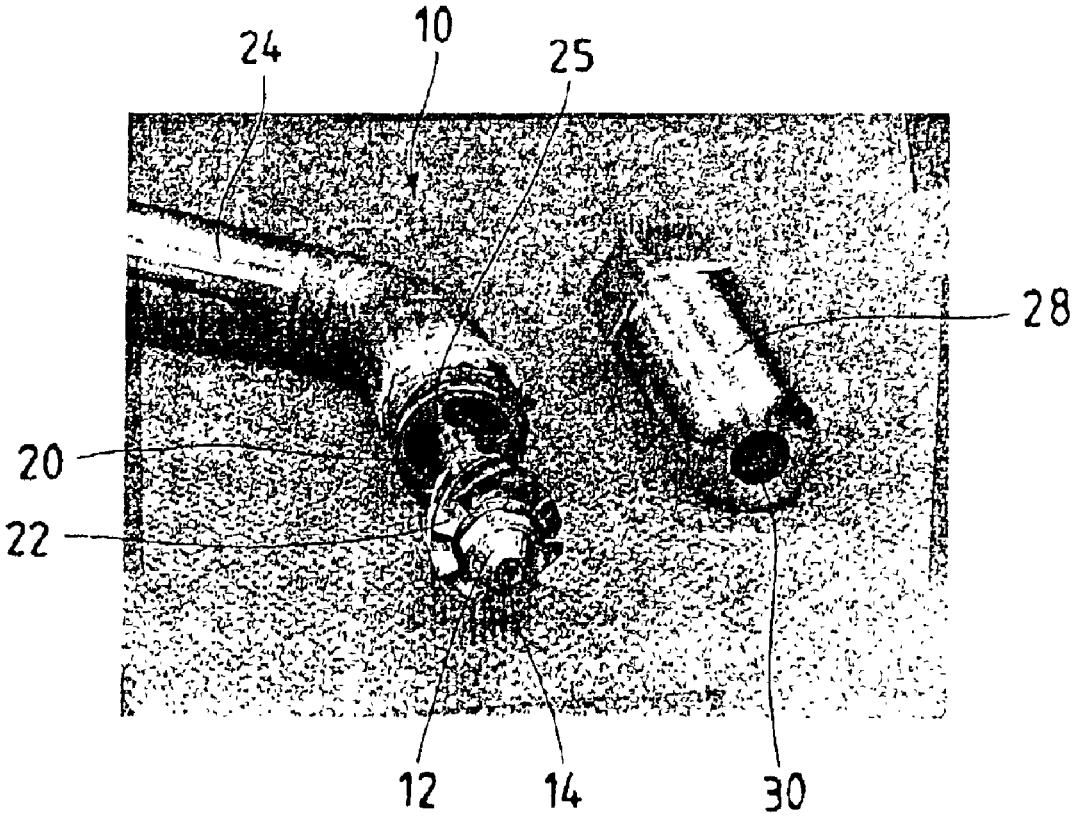
FIG. 2 is a perspective view of the injector of FIG. 1, partially dismantled.

With reference to the figures, an improved liquid fuel injector, indicated as a whole by the number 10, for burners of gas turbines is shown.

The injector 10 has an injector head 12 of truncated conical shape, having a hole 14 in its minor base for the passage of liquid fuel and having its opposite base connected to a tube 16 through which the liquid fuel is supplied.

A turbulence element, or "swirler", 18 is provided between the initial portion of the tube 16 and the injector head 12.

This element 18 comprises a central connecting duct 20 for the passage of the fuel between the tube 16 and the head 12.

The head 12 is connected to the element 18, by means of screw threading for example. Alternatively, the element 18 can be butt-welded to the tube 16.

Blading 22, extending axially and generally of helical shape, is provided outside this central duct 20.

An external tube 24 is placed around the tube 16, to form an annular cavity 26 in which pressurized air flows, this air being provided by a compressor (not shown).

Centring means 25, such as appendages which extend radially between the outside of the tube 16 and the inside of the external tube 24, are used to provide the spacing between the tube 16 and the external tube 24.

A covering element such as a cap 28, connected to the external tube 24 by screw threading for example, is provided around the head 12 and the turbulence element 18.

Thus the cap 28 creates a cavity 32 which forms an extension of the annular cavity 26 described immediately above.

At the opposite end from the external tube 24, the cap 28 encloses the injector head 12, although an aperture 30 is provided in front of the hole 14 in the said head 12.

The cap 28 is tapered around the head 12, in the truncated conical area, thus forming a cavity 34 converging towards the aperture 30 of the said cap 28.

Alternatively, the turbulence element 18 can be made by providing an initial portion of the tube 16 with axially extending blading, generally of helical form, which is similar to the blading 22 of the turbulence element 18 described previously.

The operation of the improved liquid fuel injector 10 for burners of gas turbines according to the invention is clear from the above description with reference to the figures, and is briefly as follows.

The liquid fuel is supplied from a remote reservoir through the tube 16 to the injector head 12, in such a way as to supply the main flame of the burner.

The liquid fuel injected by the injector head 12 is atomized by the inflow of air from the annular cavity 26 of the external tube 24, from the cavity 32 of the cap 28 and finally from the converging cavity 34, which therefore accelerates the air.

Before reaching the liquid fuel, this air is subjected to turbulence by the blading 22 of the element 18, which it encounters before reaching the injector head 12.

Thus the liquid fuel is formed into a suitably vaporized conical jet as it leaves the aperture 30 of the cap 28.

The above description clearly indicates the characteristics of the improved liquid fuel injector for burners of gas turbines, which is the object of the present invention, and also makes clear the corresponding advantages, which include:

reduced levels of polluting combustion emissions;

reduced pressure oscillations in the combustion chamber and good flame stability;

high combustion efficiency;

extreme compactness;

ease of assembly and dismantling, with a consequent case of maintenance.

Finally, it is clear that the improved liquid fuel injector for burners of gas turbines, designed in this way, can be modified and varied in numerous ways within the scope of the invention.

Additionally, all the components can be replaced with technically equivalent elements.

In practice, the materials used, as well as the shapes and dimensions, can be varied at will according to technical requirements which may arise from time to time.

The scope of protection of the invention is therefore delimited by the attached claims.

What is claimed is:

1. A fuel injector for a gas turbine burner comprising:

an injector head having an outlet;

a first tube for flowing fuel;

a central duct screw threaded at one end to said head and butt welded at an opposite end to said first tube, said duct having an axially extending passageway in communication with said first tube and said head for flowing fuel to said outlet;

an external tube about said first tube forming a first annular passage for flowing air under pressure;

a tubular covering element about said duct and said head and connected at one end to said external tube forming an second passage in communication with said first annular passage for flowing air from said external tube past said head;

said covering element extending axially beyond said head at an opposite end thereof terminating in an inwardly tapered opening convergent in a downstream direction from said outlet for flowing air outwardly from said injector and mixing with fuel flowing from said outlet;

a plurality of blades carried by said duct projecting into said second annular passage for imparting a swirl to the air passing along said second annular passage.

2. An injector according to claim 1 including means for centering said duct relative to said external tube.

3. An injector according to claim 2 wherein said centering means includes appendages extending radially between said first tube and said external tube.

* * * * *